US006749099B2

(12) United States Patent
Danielson

(10) Patent No.: US 6,749,099 B2
(45) Date of Patent: Jun. 15, 2004

(54) FIREARM REST HAVING SHOCK ABSORBING LINE

(76) Inventor: Steven L. Danielson, P.O. Box 137, Star Prairie, WI (US) 54026

( * ) Notice: Subject to any disclaimer, the term of this patent is extended or adjusted under 35 U.S.C. 154(b) by 0 days.

(21) Appl. No.: 09/802,266

(22) Filed: Mar. 8, 2001

(65) Prior Publication Data

US 2001/0035440 A1 Nov. 1, 2001

Related U.S. Application Data

(60) Provisional application No. 60/188,762, filed on Mar. 13, 2000.

(51) Int. Cl.[7] ..... F41C 33/02

(52) U.S. Cl. ..... 226/149; 224/250; 224/254; 224/913

(58) Field of Search ..... 224/149, 250, 224/251, 254, 913, 660, 922; 473/212, 213; 24/3.13, 3.1

(56) References Cited

U.S. PATENT DOCUMENTS

| | | | | | |
|---|---|---|---|---|---|
| 702,398 | A | * | 6/1902 | Bowyer | 224/250 |
| 1,469,285 | A | | 10/1923 | Thompson | |
| RE16,238 | E | | 12/1925 | Thompson | |
| 2,078,010 | A | | 4/1937 | Meepos | |
| 2,296,082 | A | | 9/1942 | Bierk | |
| 3,422,497 | A | | 1/1969 | Lyons | |
| 3,869,074 | A | | 3/1975 | Roach | |
| 3,908,875 | A | * | 9/1975 | Wilson et al. | 224/254 |
| 3,927,808 | A | * | 12/1975 | Steen | 224/267 |
| 3,967,668 | A | * | 7/1976 | Franco | 383/4 |
| 4,248,366 | A | * | 2/1981 | Christiansen | 224/148.6 |
| 4,420,104 | A | * | 12/1983 | Dilenno | 224/250 |
| 4,431,122 | A | | 2/1984 | Garmong | |
| 4,911,345 | A | | 3/1990 | James et al. | |
| 4,964,553 | A | | 10/1990 | Glynn | |
| 4,982,522 | A | | 1/1991 | Norton | |
| 4,993,128 | A | * | 2/1991 | Gold | 24/715.3 |
| 5,025,587 | A | * | 6/1991 | Creed | 43/55 |
| 5,029,741 | A | | 7/1991 | Easter | |
| 5,052,365 | A | * | 10/1991 | Carella | 124/90 |
| 5,075,996 | A | | 12/1991 | Llames | |
| 5,134,797 | A | | 8/1992 | Turner | |
| 5,246,154 | A | * | 9/1993 | Adams et al. | 224/257 |
| 5,325,618 | A | | 7/1994 | Turner | |
| 5,630,257 | A | | 5/1997 | Brody et al. | |
| 5,632,428 | A | * | 5/1997 | Weiss | 224/623 |
| 5,718,363 | A | | 2/1998 | Graves | |
| 5,725,135 | A | | 3/1998 | Daniel | |
| 5,765,732 | A | | 6/1998 | Brandt | |
| 5,810,219 | A | | 9/1998 | Rosenfield | |
| 5,820,000 | A | * | 10/1998 | Timberlake et al. | 224/219 |

(List continued on next page.)

FOREIGN PATENT DOCUMENTS

| | | |
|---|---|---|
| GB | 15918 | 3/1913 |

*Primary Examiner*—Gregory Vidovich
*Assistant Examiner*—Maerena W. Brevard
(74) *Attorney, Agent, or Firm*—Haugen Law Firm PLLP

(57) ABSTRACT

A firearm rest for a firearm having a butt stock. The gun rest includes a base that may be slipped onto a belt and further includes an elastic line depending from the base. The elastic line forms a loop. The butt stock is placed into the loop and on the end of the loop opposite of the base. The elastic line is selected relative to the weight of the firearm to be carried such that the elastic line gives or stretches preferably only when the user is walking. With such a selection, the line absorbs the shock generated by the firearm instead of transmitting the shock into the body of the user such as into the back of the user. The size of the loop may be adjusted by tying knots at various points in the line. The base from which the shock or elastic line extends may be an apertured leather base, a base with a tapered slot for pinching a portion of the line to adjust the size of the loop, or a belt from which an elastic strap may depend.

14 Claims, 11 Drawing Sheets

U.S. PATENT DOCUMENTS 5,881,487 A 3/1999 Chalker
5,896,623 A * 4/1999 Martin ..... 24/115 G
5,927,574 A 7/1999 Ruesink
6,038,748 A * 3/2000 Durney et al. ..... 24/302
6,056,173 A * 5/2000 Gillespie ..... 224/194
6,068,167 A 5/2000 Hopson
6,094,783 A 8/2000 Parsons
6,317,938 B1 * 11/2001 Durette ..... 24/298
6,389,655 B2 * 5/2002 Libecco ..... 24/300

* cited by examiner 10
12
42
26
30
44
38
36
42
34
28
34
40
38
40
52
50
46
48
14

10
12
26
40
42
42
32
28
36
38
40
38
50
52
46
48
14

102
42
38
106
108
110
40
114
14
46
48

100
18
118
120
42
108
110
112
116
102
40
114
104
38
14
40

Fig.-17
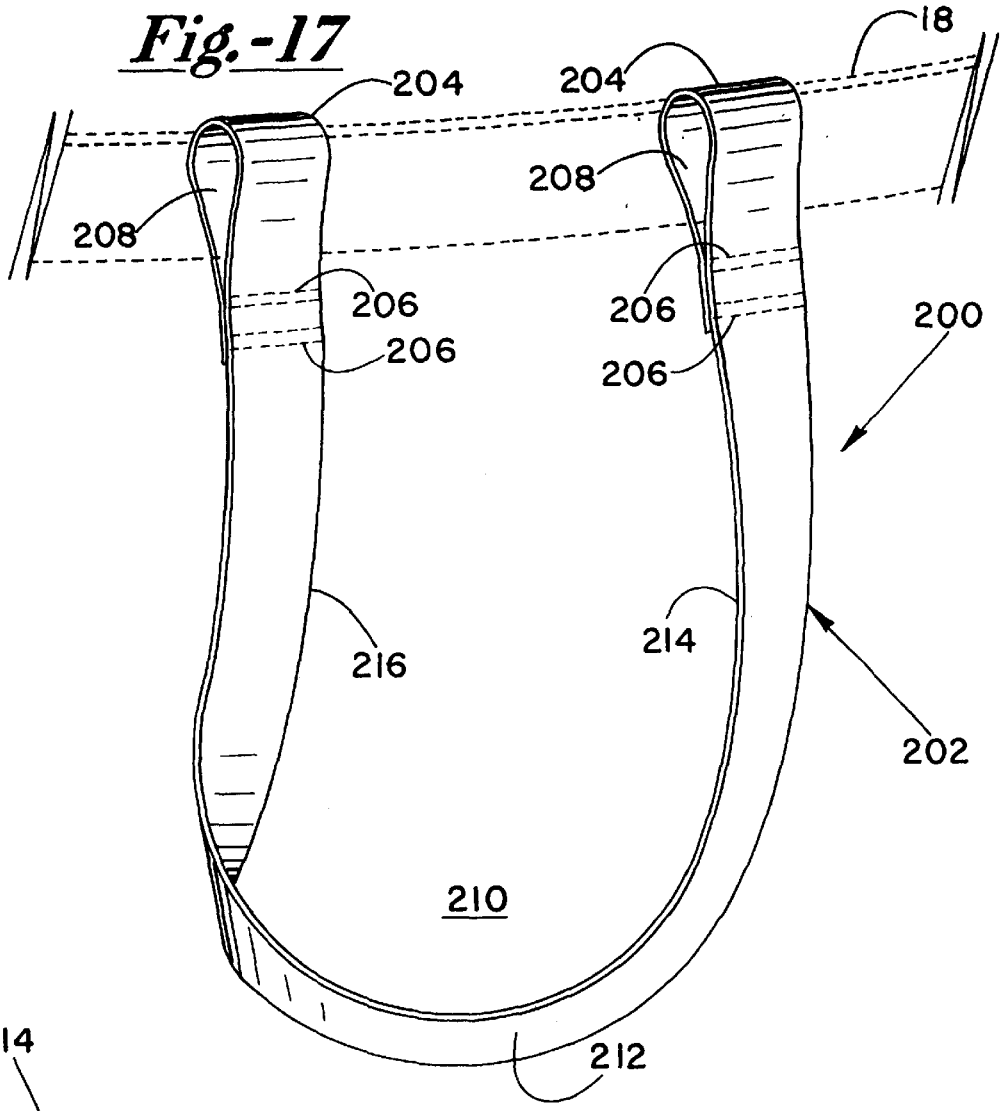
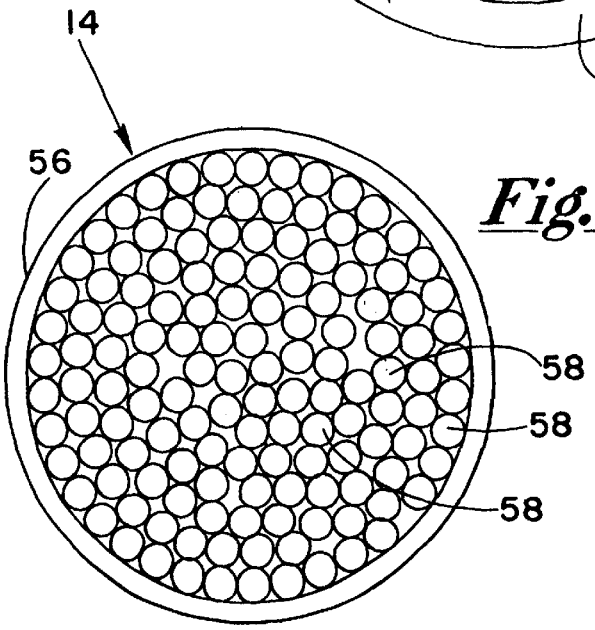
Fig.-18

FIREARM REST HAVING SHOCK ABSORBING LINE

CROSS-REFERENCE AND RELATED APPLICATIONS

This application claims the benefit under Title 35, United States Code § 119(e) of the U.S. provisional application Serial No. 60/188,762 filed Mar. 13, 2000 and entitled Device For Supporting A Long Personal Weapon. Such provisional application number 60/188,762 is hereby incorporated by reference in its entirety into this application.

FIELD OF THE INVENTION

The present invention relates generally to a gun rest for a relatively long firearm having a butt stock, particularly to such a gun rest from which the firearm may be raised immediately to a firing position, and specifically to such a gun rest that is worn about the waist or hip of the user for support of the firearm.

BACKGROUND OF THE INVENTION

Anyone who carries a rifle, shotgun or other shoulder fired weapon is faced with the problem of how to carry the weapon in a ready to raise and fire position without tiring the hands, arms, shoulder and back. Many devices have been created to solve this problem. Many of these devices incorporate a rest or support that is attached to and supported by the user's belt. These devices are to be used while the weapon is carried in a substantially vertical position, with the butt stock of the weapon resting in or on the device or is supported by the device in some fashion.

The problem with this approach is that as the user of the device walks while the device supports the weight of the weapon, the user's pelvis is slightly jarred with each step taken. As the user takes a step and shifts his or her weight onto the foot under the hip supporting the weapon, the downward motion of both the hip and the weapon is stopped. The stopping of this downward motion of the weapon jars the hip. After the user's pelvis is subjected to this jarring for an extended period of time, lower back pain usually results. The back pain is usually just above the user's pelvis.

The present invention solves this problem. The invention incorporates a length of elastic line that forms a loop hanging from the user's waist belt. The butt stock of the weapon is partially inserted in the loop and rides on and is suspended by the elastic line. As the user walks, the weapon rises and falls with each step and the elastic line absorbs the shock created by the stopping of the downward motion of the weapon. The user's pelvis is not subjected to any jarring, and the likelihood of back pain due to supporting a firearm or weapon from the hip is significantly reduced.

SUMMARY OF THE INVENTION

A feature of the present invention is the provision in a gun rest for a firearm having a butt stock, of a base worn by a user and a line depending from the base in the form of a loop for engaging the butt stock of the firearm, wherein the line includes at least one elastic portion that stretches to absorb shocks caused by upward and downward movement of the firearm relative to the user wearing the base.

Another feature of the present invention is the provision in a gun rest for a firearm having a butt stock, of a base worn by a user and a line depending from a first location, wherein the line forms a loop having two end portions engaged at the first location such that the loop pivots at the first location and a distal end of the loop can swing in an arc relative to the first location.

Another feature of the present invention is the provision in a gun rest for a firearm having a butt stock, of a base worn by a user and an elongate member depending from the base, wherein the elongate member includes an elastic portion with a minimum stretch load, wherein the minimum stretch load is sufficiently great such that the elastic portion remains relatively unstretched when a firearm of a first predetermined weight is placed therein under gravity without a user generated force (i.e., one times the force of gravity), and wherein the minimum stretch force is sufficiently weak such that the elastic portion stretches (i.e., when subjected to more than one times the force of gravity) and then retracts with each of the steps the user takes with the firearm engaged in the gun rest such that the elastic portion absorbs shock generated by the user.

Another feature of the present invention is the provision in a gun rest for a firearm having a butt stock, of a base worn by a user and a line depending from the base and having an elastic portion, wherein the elastic portion includes a maximum stretch length beyond which the elastic portion is unstretchable, wherein the maximum stretch length is sufficiently long to permit the elastic portion to absorb relatively great shocks generated by the user, and wherein the maximum stretch length is sufficiently small to keep elastic portions of the line from weakening or breaking.

Another feature of the present invention is the provision in a gun rest for a firearm having a butt stock, of a base worn by a user and a line depending from the base, wherein the length of the line may be adjusted such that the height that the firearm is carried relative to the user may be customized to a position comfortable to the user.

Another feature of the present invention is the provision in a gun rest for a firearm having a butt stock, of a base worn by a user and a line depending from the base, wherein the line includes a proximal end portion engaged to the base and a distal end portion engagable to the butt stock of the firearm, wherein the line comprises an outer extendable and nonelastic sheath and an elastic portion inside of the sheath whereby the elastic portion is protected from wear and tear generated by the butt stock of the firearm.

Another feature of the present invention is the provision in a gun rest for a firearm having a butt stock, of a base worn by the user and an elongate member depending from the base, wherein the elongate member includes two side portions that are drawn together to hug the butt stock when an elastic portion of the elongate member is stretched and that are drawn apart when the stretching force ceases so that the butt stock may be hugged and released upon engagement and disengagement of the butt stock relative to the gun rest.

An advantage of the present invention is safety. The present gun rest can carry the firing end of the firearm pointed generally in an upward direction. It carries the firearm in a natural position where a firm hand grip can be placed on the firearm. It automatically "hugs" the firearm upon engagement of the butt stock in the loop and releases its "hug" as the firearm is being lifted out of the loop.

Another advantage of the present invention is that the gun rest is shock absorbing. It absorbs shock otherwise transmitted into the user when the user walks or is otherwise active, thereby preserving strength and keeping the user more alert.

Another advantage of the present invention is that the gun rest accommodates natural movement of the user. As the user walks, the gun rest swings as naturally as possible according to the walking gait of the user. As the user raises his or her gun, the gun rest may pivot and the butt stock of the firearm may swing on an arc.

Another advantage of the present invention is simplicity. The gun rest is simple to manufacture, simple to put on and take off, simple to adjust, and simple to use.

Another advantage of the present invention is expense. The gun rest is inexpensive to manufacture and requires little or no maintenance. For example, if the gun rest is formed of leather, the leather may be oiled.

Another advantage is that the present invention, in its simple loop form, works with a variety of firearms. Rifles and shotguns used by hunters have a variety of butt stocks of different shapes and sizes, some of which are conventional and some of which are high tech. High tech rifles and assault firearms used by the military may have even different shapes and sizes, especially the relatively heavy portable firearms such as those used for attacking armored vehicles. One feature that contributes to this advantage is the "hugging" of the elastic line about the butt stock of the firearm as the butt stock is placed into the loop. The elastic line conforms to the shape and size of most any conventional or high tech butt stock.

Another advantage is that the present invention releases its hold or "hug" on the firearm automatically as the firearm is lifted from the loop. Hunters and troops need easy, free and unencumbered access to their firearm.

Another advantage is that the present invention provides a fast and direct transition without hindrance between the position in which the firearm is carried and the position in which the firearm is fired. For hunters, split seconds may be the difference between bagging a deer or returning home to wait for next year. For military troops, split seconds save lives.

Another advantage is that the present invention is relatively light and takes up a minimum of space. Ground troops may carry more than their weight in gear. The standard for adding additional gear is relatively high. The standard for adding bulky gear is even higher. Hunters too attempt to minimize the gear carried and eliminate bulk and weight.

BRIEF DESCRIPTION OF THE DRAWINGS

FIG. 17 is a perspective view of another alternate embodiment of the invention.

FIG. 18 is a section view of the line for the gun rest and shows the protective sheath and elastic interior lines.

DESCRIPTION

Figure 1:
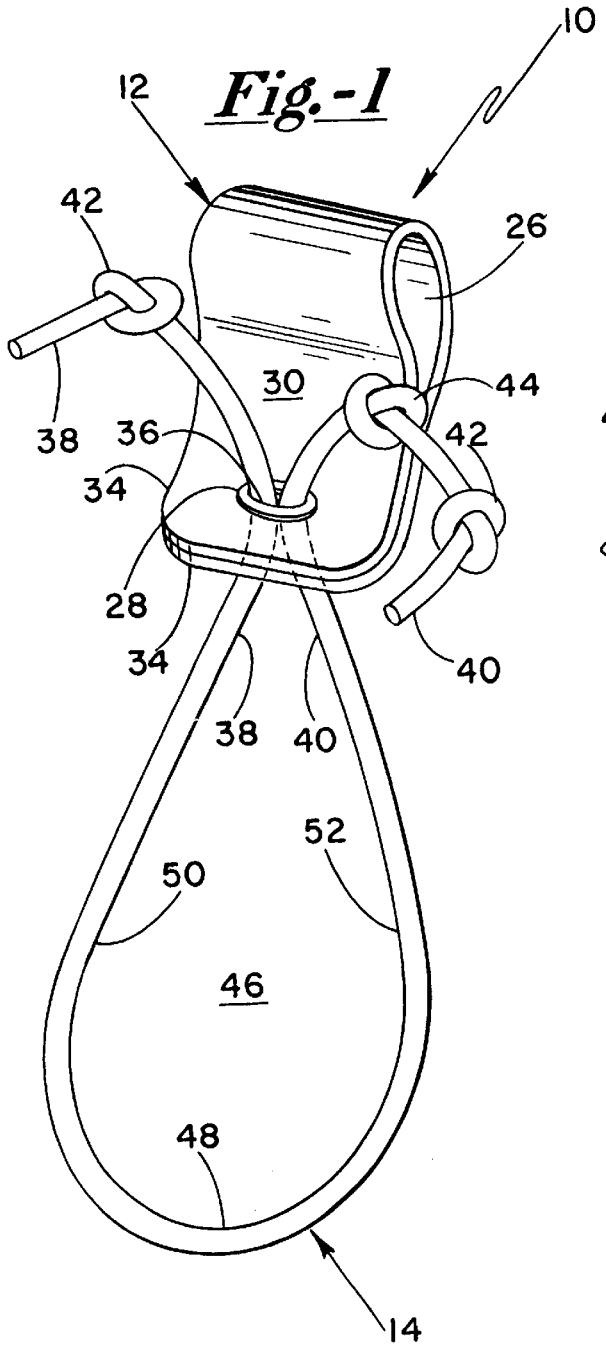
FIG. 1 is front perspective view of the present gun rest.
Figure 6:
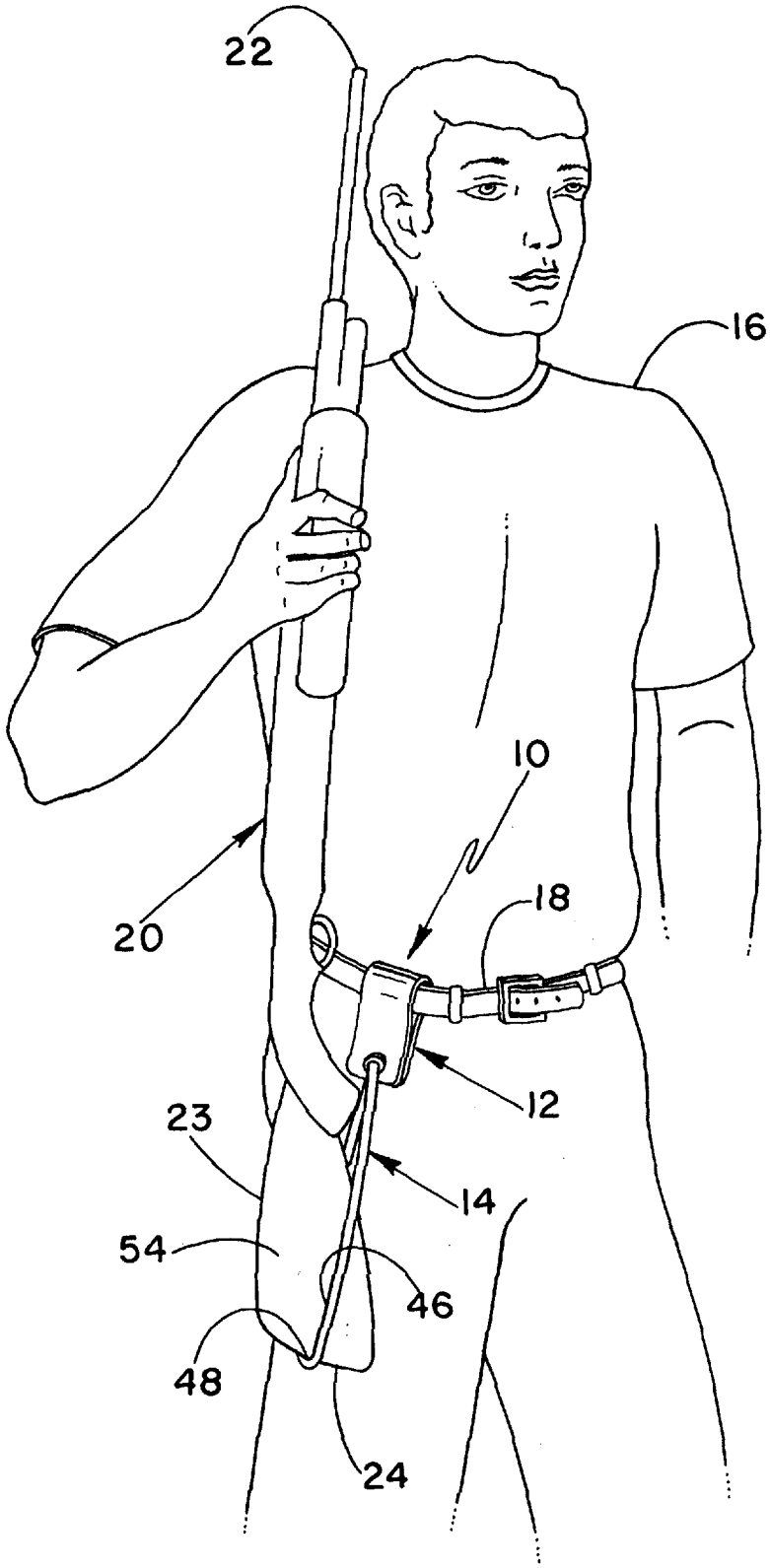
FIG. 6 is a front perspective view of a user wearing the gun rest of FIG. 1 and carrying a firearm in the gun rest and positioning the firearm upright at his side.

As shown in FIG. 1, the present gun rest is indicated in general by reference numeral 10. The gun rest 10 generally includes a base 12 and an elastic line 14 engaged to the base 12. As shown in FIG. 6, a user 16 slides the base 12 on a belt 18 and uses the gun rest 10 for carrying a firearm or weapon 20. The firearm 20 has a firing end or distal end 22 from which a projectile may exit and a butt stock 23 having a butt stock end 24 or proximal end 24 that may be held against a shoulder when firing the firearm 20. The butt stock end or proximal end 24 is placed on the elastic line 14. The elastic line 14, instead of the user 16, absorbs shock generated when the user 16 walks with the relatively massive firearm.

Figure 2:
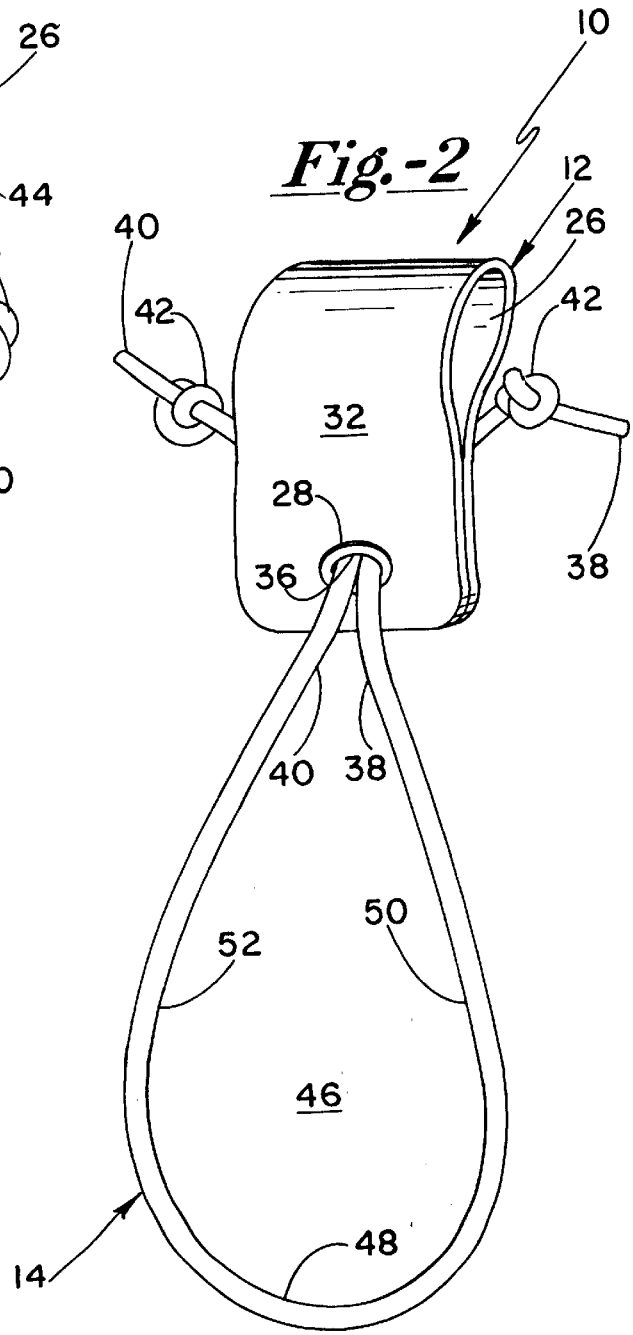
FIG. 2 is a rear perspective view of the gun rest of FIG. 1.
Figure 3:
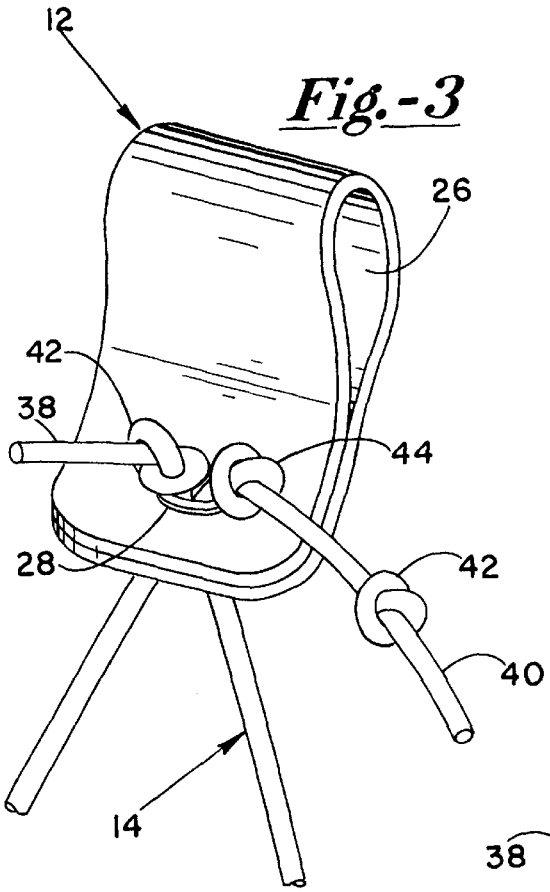
FIG. 3 is a front perspective view of the gun rest of FIG. 1 showing how a knot may adjust the size of the loop of the line and the height of the gun rest.
Figure 4:
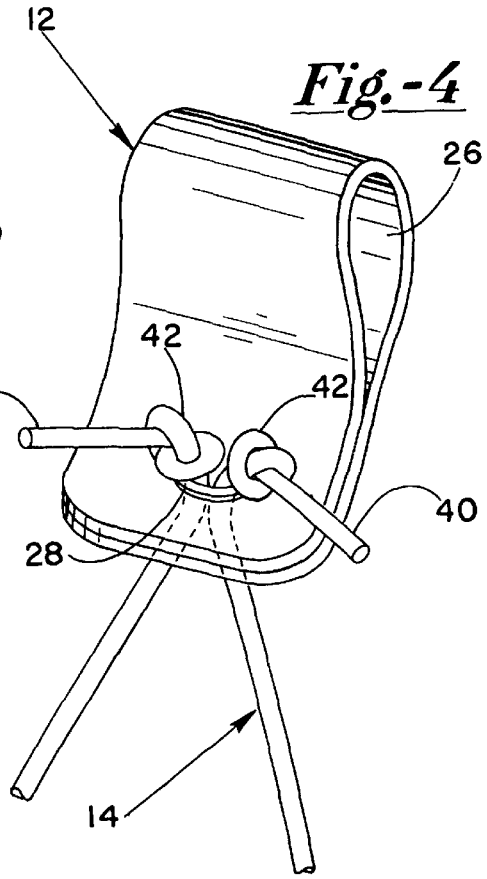
FIG. 4 is a front perspective view of the gun rest of FIG. 1.

More particularly, as shown in FIG. 1, the base 12 is a strip of leather folded over to form a belt loop or opening 26. The base 12 is fixed in such folded over position with a grommet 28. The base 12 includes an outer face 30 preferably facing outwardly and away from the user 16 when the gun rest 10 is worn by the user 16. A logo or other indicia may be formed in the outer face 30. As shown in FIG. 2, the base 12 includes an inner face 32 which preferably faces inwardly toward the user 16 when the gun rest 10 is worn. Since the base 12 includes no stitching, edge portions 34 (as shown in FIG. 1) of the strip of leather can be peeled away from each other back to the grommet 28, which is the sole means for fixing the base 12 in the folded over position. The base 12 is aesthetic, water-resistant, resistant to being torn and relatively light. The base 12 may be formed of a nylon, nylon webbing, nylon-like material, flexible plastic material or durable fabric. The base 12 has a width, defined by the horizontal length of the opening 26 through which the user's waist belt 18 runs, that is relatively long to distribute pressure over a relatively great area of belt 18. The width of the base 12 (or the horizontal length of the opening 26) is preferably between one and seven inches, more preferably between one inch and four inches, and most preferably between about two inches and three inches. The grommet 28 forms an opening 36.

The elastic line 14 extends through the grommet opening 36. The elastic line 14 includes two end portions 38, 40. Each of the end portions 38, 40 includes an end knot 42. End portion 40 includes a further knot 44, which is tied at a customized location to increase or decrease the size of a loop 46 formed by the elastic line 14 and therefore to raise or lower the effective height of the lower portion 48 of the loop 46.

The size of each of the knots 42 and 44 is greater than the size of the grommet opening 36 to prevent the line 14 from slipping through the grommet opening 36. Further, the diameter of the grommet opening 36 and the diameter, texture, and degree of resilience of the line 14 are selected such that, when the end portions 38 and 40 of the line 14 are tugged and pulled through the grommet 28, some resistance is offered by the end portions 38 and 40 sliding against each other and by the end portions 38 and 40 sliding against the inner diametrical edge of the grommet 28. This resistance keeps the line 14 from falling out of the base 12 or from being accidentally drawn out of the base 12 by drawing the loop 46 through the grommet opening 36.

The loop 46 includes a distal end portion or receptor 48 on which the butt stock 24 is placed. The loop 46 further includes side portions 50 and 52. Loop side portions 50 and 52 confront right and left side surfaces 54 of the firearm 20 (as shown in FIG. 6). The loop 46 includes a pivot point, with such pivot point being at the grommet 28. Distal end portion 48 of the loop 46 swings in an arc defined by the pivot point. This pivot point or first location includes an axis which extends into the body of the user 16 such that the loop 46 swings generally in a plane that is tangential to the body of the user 16.

Loop side portions 50 and 52 are drawn together when the loop 46 is stretched as a whole. Accordingly, loop 46 "hugs" the butt stock 23 of the firearm 20. When such stretching force is released the loop side portions 50 and 52 are drawn apart and the "hug" is released.

As shown in FIG. 18, the elastic line 14 includes a protective sheath 56 and a plurality of elongate elastic interior lines 58 housed in the sheath 56. The protective sheath 56 is a woven polymeric material such as nylon. The protective sheath 56 itself is extendable, but is not elastic. The protective sheath 56 provides a maximum length of elongation for the line 14. In other words, the protective sheath 56 stops further stretching of the elastic interior lines 58 when the protective sheath 56 reaches its point of maximum extendability. If desired, the protective sheath 56 may be formed of an organic material such as cotton.

The maximum length of elongation of the line 14 is sufficiently long to permit the interior elastic lines 58 to absorb relatively great shocks generated by the user 16 walking without the loop 46 "bottoming out" (i.e., reaching its point of maximum elongation wherein shocks are transmitted to the user 16). The maximum length of elongation of the line 14 is sufficiently small to keep from weakening the elasticity of the interior elastic lines 58 or to keep the interior elastic lines 58 from breaking.

The elongate elastic interior lines 58 (or the line 14 as a whole) include a minimum stretch load. That is, the interior lines 58 will stretch only when weight of a predetermined amount is placed on the distal end 48 of the loop 46. This minimum stretch load is sufficiently great such that the interior lines 58 remain relatively unstretched when a firearm 20 of a first predetermined weight is placed on the distal end 48 of the loop 46 under the force of gravity and without an accompanying user generated force. This minimum stretch load is sufficiently weak such that the interior lines 58 stretch and then retract with each of the steps of the user when the user 16 is walking with the firearm 20 of the first predetermined weight engaged in the distal end portion 48 under the force of gravity such that the interior lines 58 absorb shock generated by the user 16 walking.

If the firearm 20 when on the distal end portion 48 of the loop 46 is relatively lightweight (or if the interior lines 58 are selected so as to be too strong), the elastic line 14 may not stretch (and thereby absorb shock) even if the user 16 is walking.

The maximum length of elongation of the line 14 may be adjusted by tying knot 44 at different positions on end portion 40 so as to raise and lower distal end portion 48 when no butt stock is engaged. This also raises and lowers the maximum length of elongation of the line 14.

To mount the line 14 on the base 12, the first step is to tie the knots 42. Then the middle section of a small diameter wire is fed through the grommet 28 such that the middle section of the small diameter wire forms a loop on one side of the grommet 28 and such that the ends of the small diameter wire remain on the other side of the grommet 28. The line 14 for the gun rest 10 is then inserted halfway through the loop of small diameter wire. The ends of the small diameter wire are then grasped and pulled back to draw the loop of small diameter wire through the grommet 28 along with the line 14 that is held by the loop of small diameter wire. Since the knots 42 are tied and found on the end portions of the line 14, the line 14 cannot be drawn completely through the grommet opening 36 as the small diameter wire tugs the line 14 through the grommet 28.

In operation, the gun rest 10 is slid onto belt 18 and the belt 18 is secured. One preferred position for the gun rest 10 is about the waist slightly in front of the hip. Then the preferred height of the distal end 48 is adjusted for each or both of an at rest position (where no firearm 20 is engaged in the loop 46 or where the firearm is engaged in the loop 46 with no stretching of the loop 46) or an operating position (where the firearm 20 is engaged in the loop and/or the user is generating alternate upward and downward forces caused by walking). Such an adjustment is accomplished by tying knot 44, testing the shock absorbed by the loop 46 and testing to determine how far the loop 46 will stretch until it "bottoms out." Once the size of the loop 46 has been customized such as by tying the knot 44 and then tying such knot at a different position to form a loop 46 of greater or smaller size, the gun rest 10 is ready for use in the field.

Figure 7:
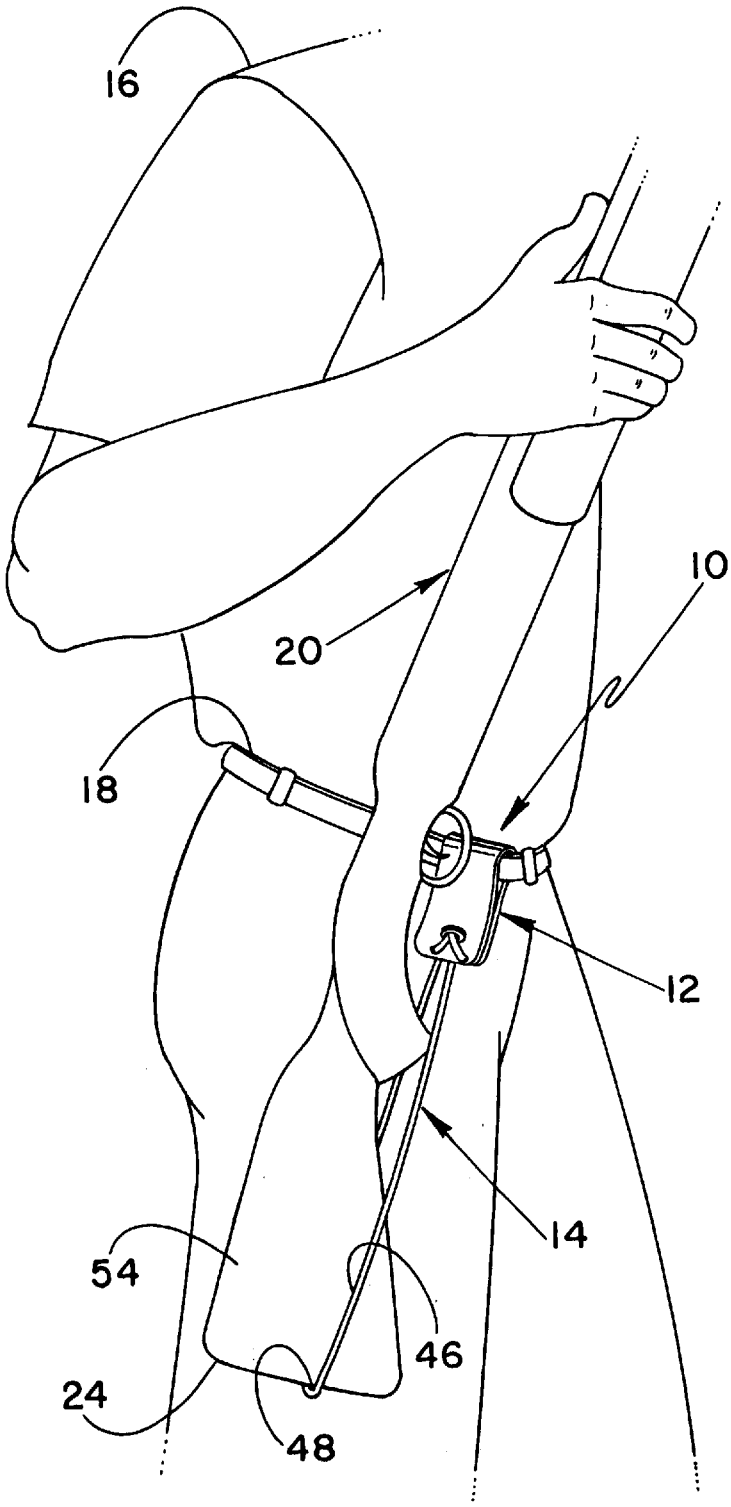
FIG. 7 is a side perspective view of a user wearing the gun rest of FIG. 1 and carrying a firearm in the gun rest and positioning the firearm upright at his side.
Figure 8:
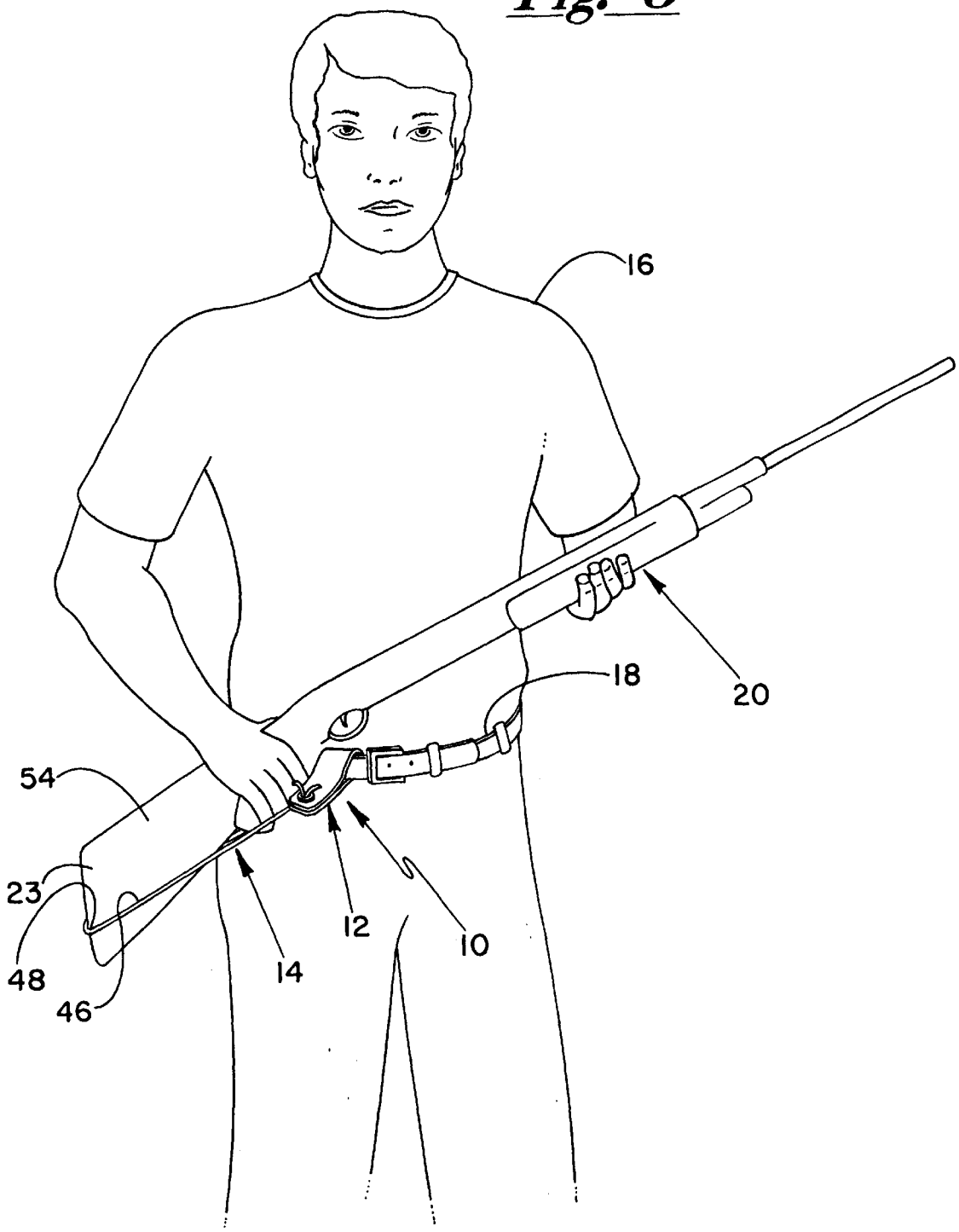
FIG. 8 is a front perspective view of a user wearing the gun rest of FIG. 1 and carrying a firearm in the gun rest and positioning the firearm across his midsection.

In the field, with the butt stock 24 engaged in the loop 46, the elastic line 14 instead of the user's back absorbs shock caused by walking. When the user 16 is standing with the butt stock 24 engaged in the loop 46, the loop 46 preferably remains relatively unstretched. When the user 16 is walking, the user 16 generates a force that will cause the firearm 20 to move vertically up and down, whereupon the loop 46 stretches without bottoming out to thereby absorb such walking generated force. Relative to the ground, the butt stock 24 may define a sinusoidal wave when the user 16 is walking whether the user 16 is carrying the firearm 20 at his or her side, such as in FIGS. 6 and 7, or in front of his or her midsection, such as shown in FIG. 8. When the user 16 is inactive such as when the user 16 is standing and when the user 16 is active such as when the user 16 is walking, the loop 46 (with its engaged butt stock 24) may pivot relative to the grommet 28. This pivoting action permits the arm holding the firearm 20 to swing as naturally as possible. This pivoting action further permits without hindrance the step of raising the firearm 20 to a firing position. While the step of raising the firearm 20 to a firing position may be done differently according to the user 16, such a step involves raising the firearm 20 to the shoulder and turning the gun to a horizontal position. If the firearm 20 is turned horizontally before or while the firearm 20 is being raised, the butt stock 24 may still be engaged in the loop 46 while the firearm 20 is being turned horizontally. The pivoting action of the loop 46 permits such to occur and further permits the distal end 48 of the loop 46 to slip off the butt stock 24 as the firearm 20 is being turned horizontally and raised.

After raising his or her firearm 20 to the firing position, the user 16 may again engage the butt stock 24 with the loop 46. The loop 46, though relatively small, is easy to locate by touch, such that the user 16 can remain visually attentive.

Figure 10:
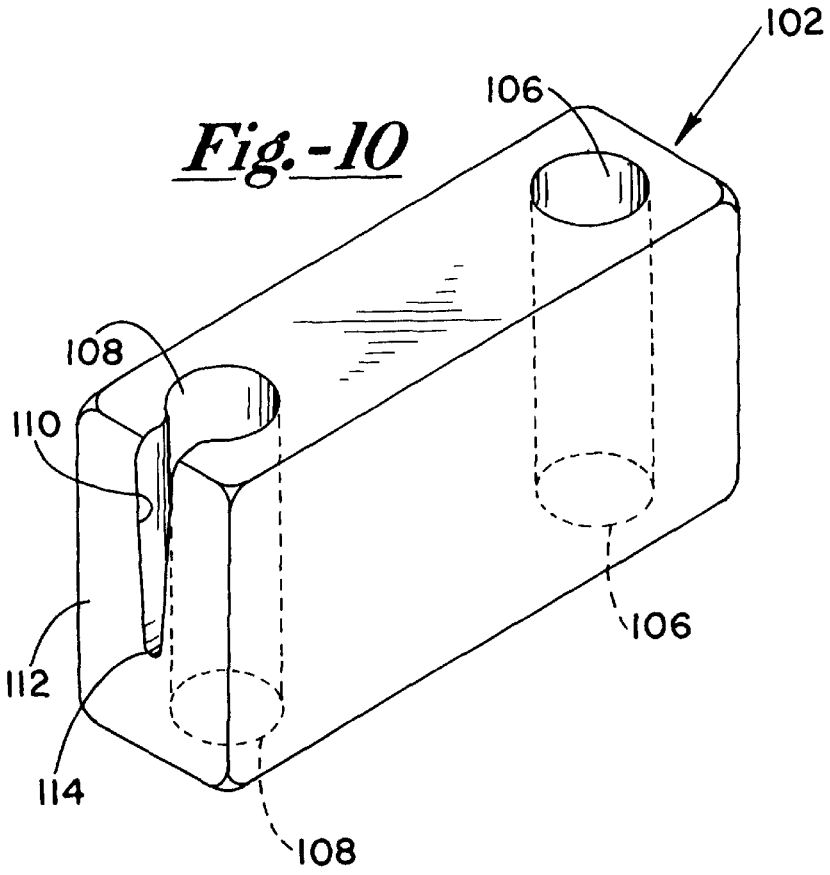
FIG. 10 is a perspective view of an alternative embodiment of the base of the gun rest.
Figure 11:
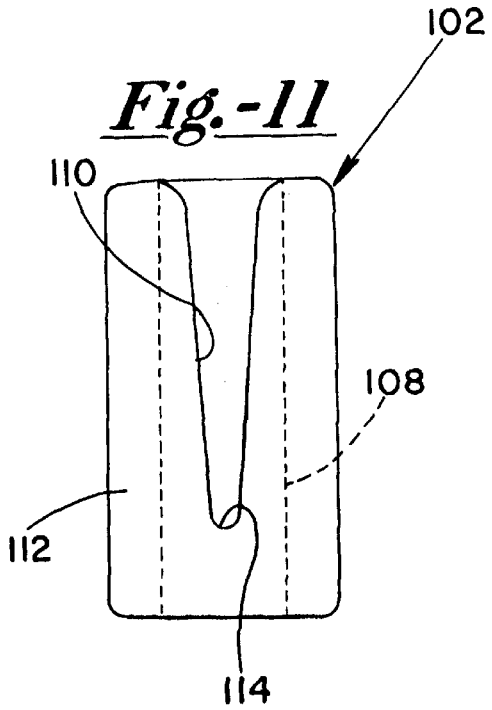
FIG. 11 is a side view of the base of FIG. 10.
Figure 12:
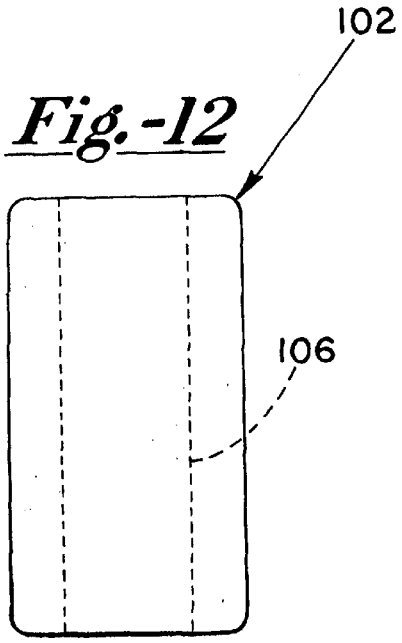
FIG. 12 is a side view of the base of FIG. 10.
Figure 13:
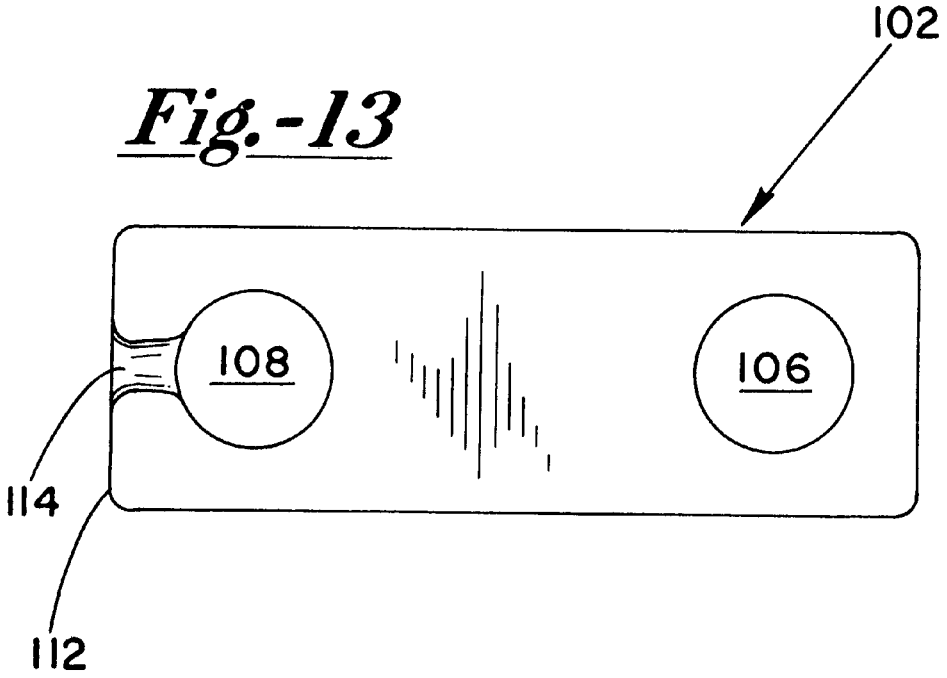
FIG. 13 is a top view of the base of FIG. 10.
Figure 14:
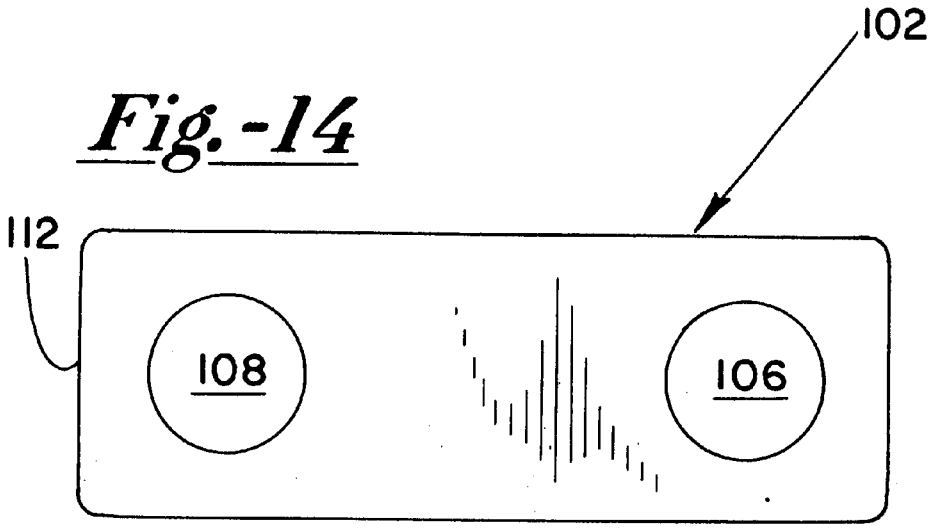
FIG. 14 is a bottom view of the base of FIG. 10.
Figure 15:
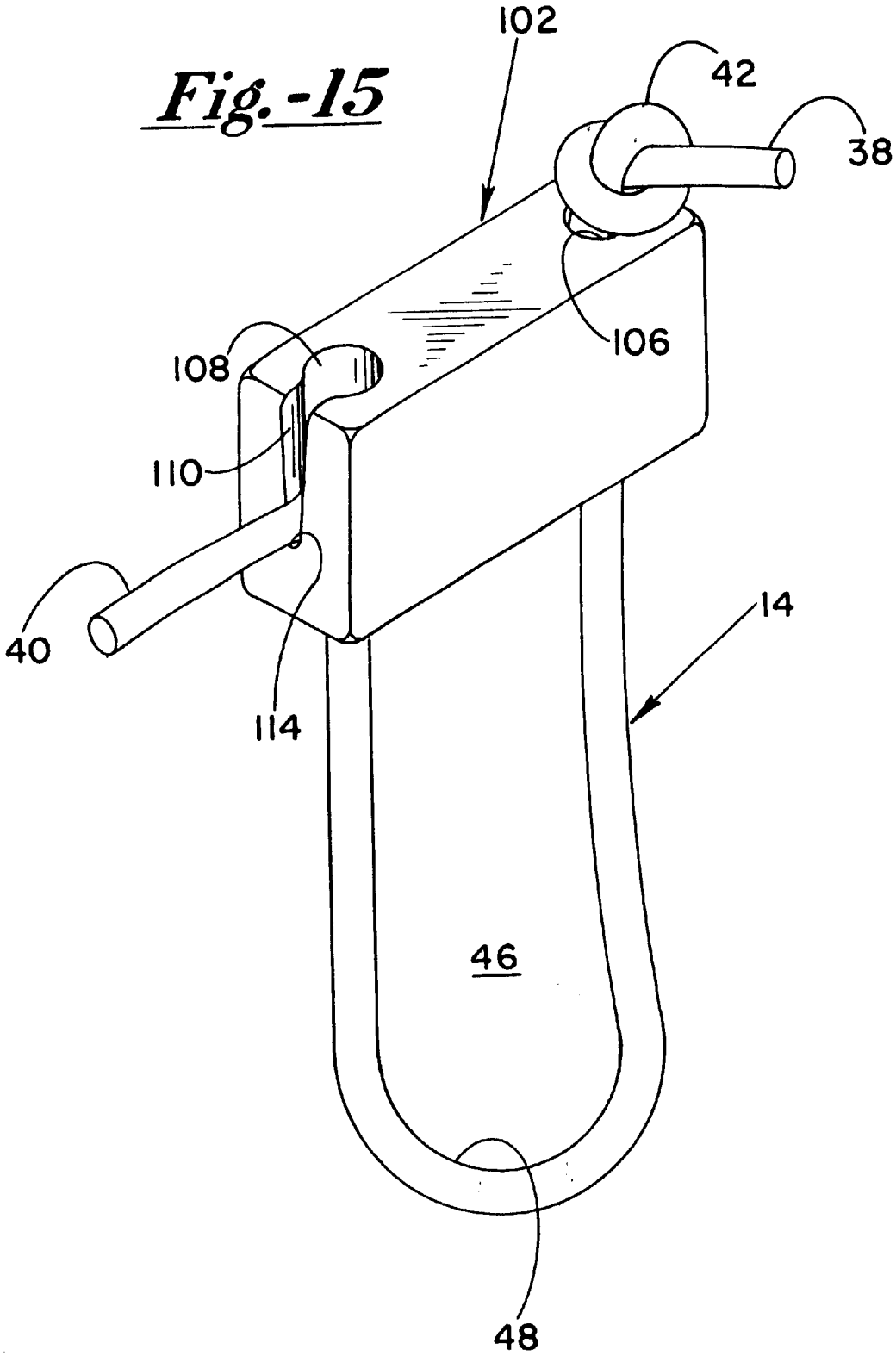
FIG. 15 is a perspective view of the base of FIG. 10 and further shows an elastic shock absorbing line engaged in the base.
Figure 16:
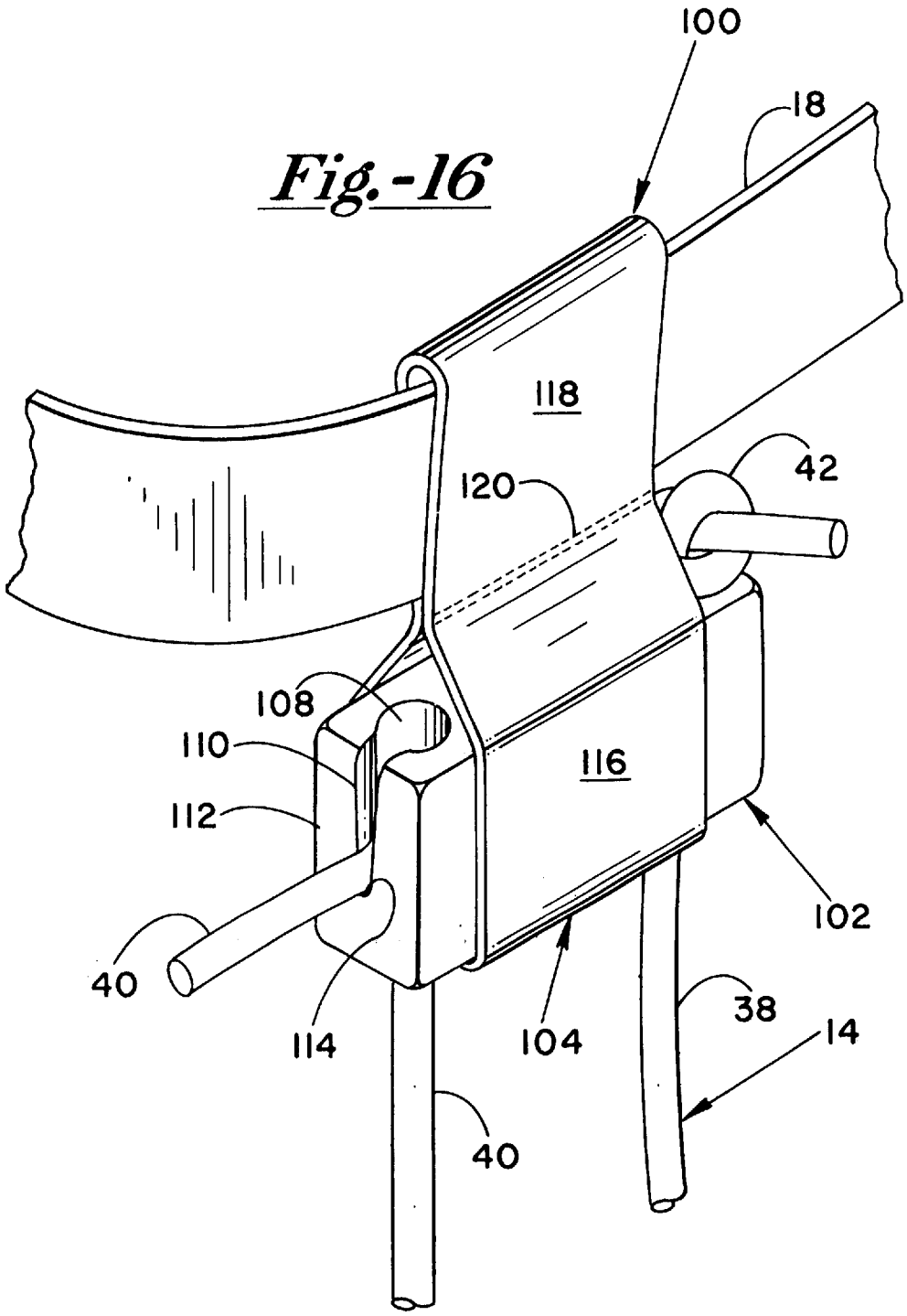
FIG. 16 is a perspective view of the base and shock absorbing line of FIG. 15 and shows how the base can be engaged to a belt of a user.

An alternate embodiment of the invention is shown in FIGS. 10–16. In this embodiment, as shown in FIG. 16, a gun rest 100 includes a first base portion or block 102, a second base portion 104, and the line 14. As shown in FIG. 10, the base portion 102 is a block, such as a block of plastic. The block 102 includes an aperture 106 for line end portion 38. Knot 42 on end portion 38 prevents line end portion 38 from being pulled out of the block 102. Block 102 includes a second aperture 108 having a side tapered opening 110 formed in an end 112 of block 102. A distal end 114 of the tapered opening 110 pinches line end portion 40 sufficiently to prevent line end portion 40 from being drawn out of aperture 108 even when firearm 20 is engaged in loop 46 and even when the firearm 20, pursuant to a user generated force such as walking, stretches the line 14 to where it "bottoms out." Base portion 104 includes a first sleeve 116 for receiving block 102 and a second sleeve 118 for receiving belt 18. Stitching 120 separates and defines the two sleeves 116, 118. Base portion 104 is preferably a strip of leather stitched so as to form the double sleeves 116, 118.

Another alternate embodiment of the invention, a gun rest 200, is shown in FIG. 17. Gun rest 200 includes a strap 202 of elongate and elastic material. Strap 202 includes two end portions 204. Each of the end portions 204 is doubled over and stitched, via stitching 206, to form belt receptors or loops 208. When placed on the belt 18, the strap 202 forms a loop 210 because the end portions 204 confront each other. Loop 210 includes a distal section 212 for engaging the butt stock 24 of firearm 20 and loop side sections 214 and 216 for engaging or confronting sides 54 of the butt stock 23 of the firearm 20. Strap 202 includes a minimum stretch load and a maximum length of elongation. One base for gun rest 200 is the belt 18. Some thread portions of the strap 202 may be elastic. Other thread portions of the strap 202 may be nonelastic to provide the maximum length of elongation.

It should be noted that each of line 14 and strap 202 is an elongate member. An elongate member is a linear or line-like member whose length is substantially greater than its width.

Figure 5:
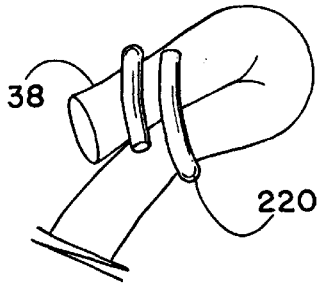
FIG. 5 shows an alternative embodiment of the invention, where an alternate method is used for finishing the ends or end portions of the line.

Another alternate embodiment of the invention is shown in FIG. 5. Here, a wire 220 may be crimped on one of the line end portions, such as line portion 38. Line portion 38 is folded over (i.e., doubled back) and the wire 220 holds the line end portion 38 in such folded over position to prevent the line end portion from slipping through grommet 28. Instead of a knot or a crimped wire, an end portion of the line 14 may be doubled back and stitched, tied with a twist tie, or fastened by some other means so as to hold the end portion in the doubled back position so that the end portion of the line 14 has a size greater than the size of the grommet opening 36.

Figure 9:
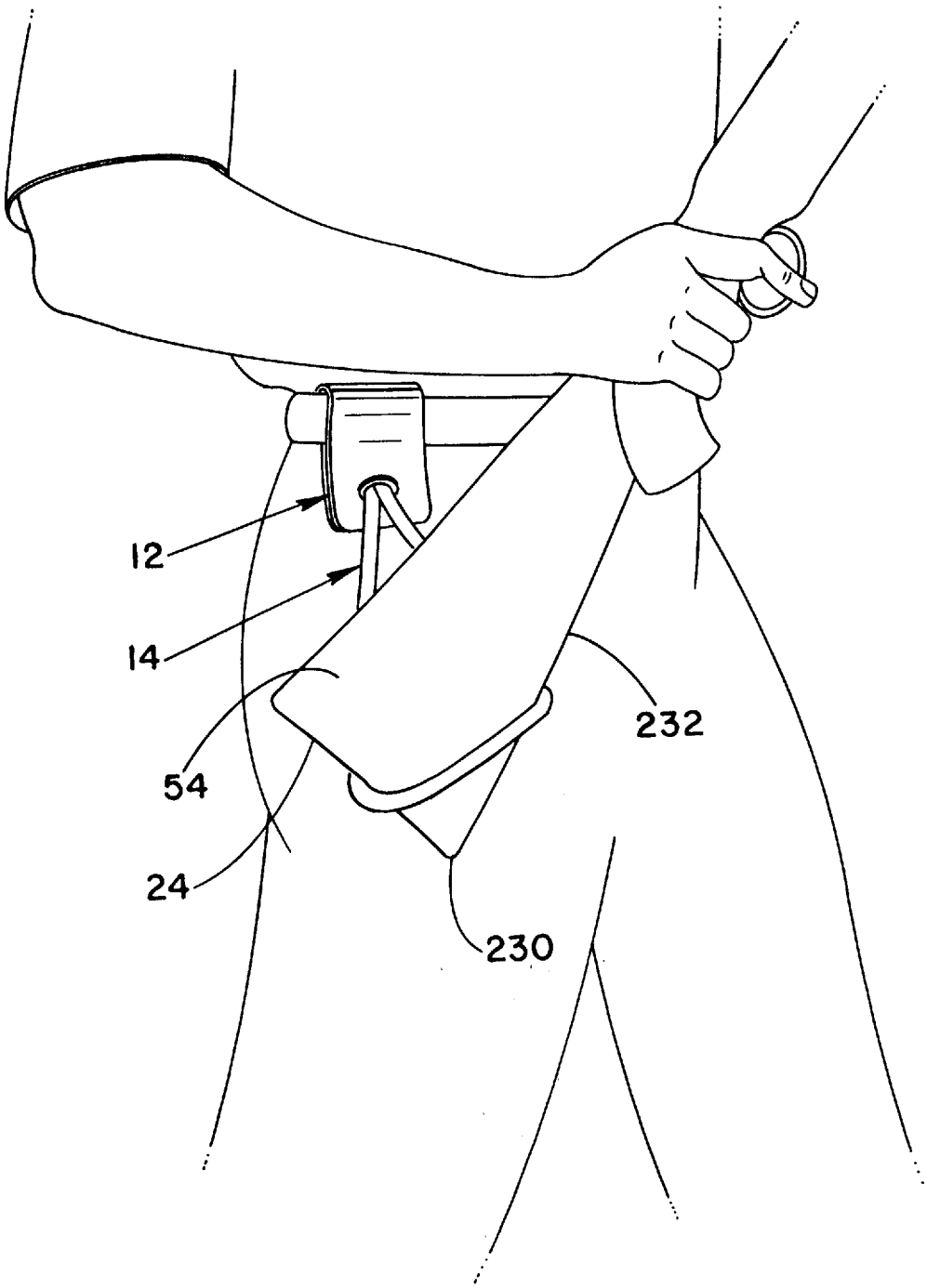
FIG. 9 shows the gun rest of FIG. 1 with a corner of the butt stock engaged in the loop of the gun rest.

FIG. 9 shows how a corner portion 230 of the butt stock 23 is disposed in the loop 46. Here the loop 46 engages butt stock end 24, one side face 54 of the butt stock 23, an angled bottom edge 232 of the butt stock 23, and the other side face (that is opposite of side face 54). Accordingly, loop 46 engages or "hugs" two side faces of the butt stock, an end, and an edge of the butt stock. Corner portion 230 of butt stock 23 is the "lowest" corner of the butt stock.

In each of FIGS. 6, 7, 8 and 9, the elastic line 14 is "hugging" the butt stock 23 of the firearm 20. In other words, the elastic loop 46 is confronting and/or making contact with the right and/or left sides of the butt stock and is further confronting and making contact with at least one end or edge of the butt stock 23. This "hug" or hold is automatically placed on the butt stock 23 under the force of gravity.

When using the gun rest 10, it is preferable that the firearm 20 is tilted forward at least 25 degrees from the vertical.

It is preferable to wear the gun rest 10 with the outer surface 30 facing outwardly, with the knots 42 and 44 also facing outwardly, not tucked between the base 12 and the waist of the user 16. This position forces the loop 46 to hang next to one's leg away from projections, such as brush.

On uneven terrain, it is preferable to wear two gun rests 10, one each on each side of the waist, such as on the hip or slightly ahead of the hip. In such situations, the firearm 20 is preferably engaged in the gun rest 10 on the downhill side, so that in the event of a fall, the uphill hand is free to arrest the fall. Further, wearing two gun rests 10 permits the user to carry the firearm 20 in one gun rest for a period of time and then switch the firearm 20 to the other gun rest 10 on the other hip. This distributes the load of the massive firearm 20 and increases circulation in the back, arms and shoulders.

The base 12, if formed of leather, is preferably oiled from time to time.

The base 12, if desired, may be omitted, and another base 12 may be selected, such as the belt 18. Another base that may be used is the belt of a fanny pack. Base 12 is a support for the line 14.

If knots 42 and 44 are retied, it is preferable to retie such firmly. A simple overhand knot, such as knot 42 or 44, is preferred. It is preferable to leave about one inch of line free beyond each knot to the terminal end of the line.

The line 14 is preferably stretchable along its entire length. However, the line 14 may be elastic at only one portion or at several portions, such as at a middle portion and/or at a portion or portions offset from the middle portion.

The line 14 is preferably an elastic cord. However, the line 14 may be a stretch cord, bungee cord, rubber rope or surgical tubing or an elastic strap, such as elastic strap 202. Surgical tubing is a rubber or elastomeric line that is tubular.

The minimum stretch load or the maximum length of elongation or both are preferably related to the weight of the firearm 20 plus all or part of the weight of the arm of the user 16. As the user 16 walks, he or she may grow tired and allow the firearm 20, and therefore the line 14, to partially or completely support his or her arm along with perhaps a portion of the weight of his or her shoulder. The heavier the load, the longer the maximum length of elongation. The heavier the load, the greater the value is for the minimum stretch load.

As indicated above, the line 14 is preferably sufficiently weak in elasticity to permit the firearm 20 to float (or travel up and down) over about generally two inches with each step the user takes. The line 14 is sufficiently strong in elasticity so as to prevent stretching until the user 16 generates force such as walking, whereupon the line 14 stretches and retracts with each of the steps of the user 16. The line 14 is further sufficiently strong in elasticity so that it does not reach its fully elongated length where it "bottoms out."

The weapon 20 is preferably a firearm. The firearm may be a rifle, shotgun or muzzle loader. The firearm may be a portable rocket launcher or light machine gun. The gun rest 10 may also carry other types of weapons such as high tech bows or crossbows.

The base 12 for supporting or holding the line 14 may be eliminated. In its place, belt 18 may be used. Belt 18 may be a utility belt or a dress belt. Belt 18 may further be a fanny pack waist belt or backpack waist belt. Or the line 14 may lead into and be an integral portion of a belt that extends about the waist of the user 16.

If desired, the minimum stretch load may be less than the weight of the firearm 20 such that, when the loop 46 is supporting only the firearm 20 and the user 16 is not active, the loop 46 stretches about 5% to 10% of its length (as defined by distal end 48). When the user 16 walks, the loop 46 may stretch up to about 50% of its length (as defined by distal end 48). When the user 16 jumps off an object about two feet high with the firearm 20 engaged in the loop 46, the loop 46 preferably stretches about 80% of its original length and preferably does not "bottom out" even with such a stretch.

A loop, such as loop 46, is preferred. A loop is where ends or end portions such as end portions 38, 40 confront each other such as at grommet 28 as shown in FIG. 1. A loop 46 and a pivot location (such as grommet 28) is most preferred. Less preferred is a loop 46 such as shown in FIG. 15, where the end portions 38 and 40 confront each other without engaging each other and where there is no pivot location. However, both of the embodiments of FIG. 1 and FIG. 15 have the end portions 38 and 40 separated by less than the thickness of a conventional rifle or shotgun such that that the loop 46 of both gun rests 10 and 100 hugs the sides or side faces of the conventional butt stock 23. Gun rest 200 is capable of forming a loop because the sleeves 208 may be drawn to confront each other such that the side sections 214 and 216 will confront the sides of butt stock 23 and may be drawn further together to make contact with each other whereupon the side section will more tightly hug the sides of butt stock 23.

It should be noted that the loop 46 includes at least first, second and third positions. The first position is where the loop 46 is at rest with no butt stock engaged in the distal portion 48 of the line 14. This first position is shown in FIGS. 1–4, 15 and 17. The second position is where the loop 46 is under a load of the butt stock 23 engaged in the distal portion 48 of the line 14 and where the elastic portion of the line is relatively unstretched. This second position is shown in FIG. 9. The third position is where the loop 46 is under a load of the butt stock 23 engaged in the distal portion 48 of the line 14 and where the elastic portion is stretched. This third position is shown in FIGS. 6, 7 and 8. In the third position, the distal portion 48 of the line 14 is disposed further from the base 12 than when the loop 46 is in one of the first and second positions.

It should be noted that, while FIGS. 6, 7 and 8 show the line 14 stretched, another line 14 having a greater length may be selected so as to form a loop of a greater size, such that a firearm may be carried in the position shown in FIGS. 6, 7 and 8 with an unstretched or relatively unstretched line.

The distal end or far end 48 of the loop 46 is the end of the loop 46 opposite of the base 12. The distal end 48 of the loop 46 is the receptor for the butt end 24 of the butt stock 23.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A waist positioned firearm rest in combination with a firearm, wherein the firearm includes a butt stock, wherein the firearm rest comprises:

a) a base adapted to be worn by a user at his or her waist, wherein the base includes a first location;

b) a line depending from the first location, wherein the line is of sufficient strength to support a weight of the firearm, wherein the line comprises two end portions, wherein the two end portions are engaged to the base at the first location, wherein the line forms a loop between the two end portions such that, when the butt stock of the firearm is placed in the loop on a portion of the line, the line supports the butt stock, wherein the loop includes a distal portion engaging the butt stock, and wherein the loop pivots relative to the first location such that the distal end portion of the loop and the butt stock can swing in an arc relative to the first location; and c) wherein the first location comprises an opening and wherein the two end portions of the line extend through the opening, wherein the opening includes a size, wherein the size of the opening is less than a size of a knot tied in the end portion of the line such that the knot may not pass through the opening, such that a size of the loop can be changed by changing a location of the knot on the line, whereby the loop can be made greater or smaller in size such that the distal portion engaging the butt stock can be easily adjusted toward and away from the base.

2. The combination of claim 1, wherein the line comprises at least one elastic portion such that, when the butt stock of the firearm is placed in the loop on a portion of the line, the elastic portion stretches to absorb shocks caused by upward and downward movements of the firearm relative to the user wearing the base.

3. The combination of claim 1, wherein the first location includes an axis about which the loop pivots, and wherein the axis extends into the user.

4. A waist positioned firearm rest in combination with a firearm, wherein the firearm includes a butt stock, wherein the firearm rest comprises:

a) a base adapted to be worn by a user at his or her waist, wherein the base includes an opening having a size; and b) a line depending from the opening, wherein the line is of sufficient strength to support a weight of the firearm, wherein the line comprises a proximal end portion, wherein the line includes a distal receptor portion for engaging the butt stock of the firearm, wherein the proximal end portion includes at least one knot tied therein, wherein the knot includes a size greater than the size of the opening such that the base about the opening prevents the knot from passing through the opening such that the distal receptor portion may be fixed at various locations toward and away from the base by changing the location of the knot on the line.

5. The combination of claim 4, wherein the line comprises at least one elastic portion such that, when the butt stock of the firearm is placed in the distal receptor portion, said at least one elastic portion stretches to absorb shocks caused by upward and downward movements of the firearm relative to the user wearing the base.

6. A waist positioned firearm rest in combination with a firearm, wherein the firearm includes a butt stock and is massive, wherein the firearm is selected from the group of firearms consisting of rifles, shotguns, muzzle loaders, assault firearms, light machine guns and portable rocket launchers, wherein the firearm rest comprises:

a) a base adapted to be worn by a user at his or her waist to support a weight of the firearm;

b) a line depending from the base, wherein the line is of sufficient strength to support the weight of the firearm, wherein the line comprises a proximal end portion engaged to the base and a distal end portion engagable to the butt stock of the firearm, wherein the line comprises an outer extendable and relatively nonelastic sheath and a plurality of elongate elastic interior lines housed inside of the sheath whereby the plurality of elongate elastic interior lines are protected from wear and tear generated by the butt stock of the firearm; and c) wherein the base is a support for the line which in turn supports the weight of the firearm that is massive such that the firearm rest supports the firearm when the user is walking and such that the firearm rest absorbs walking generated force.

7. The combination of claim 6, wherein the outer sheath comprises a braided material.

8. The combination of claim 6, wherein the outer sheath comprises a woven material.

9. The combination of claim 6, wherein the outer sheath comprises a plastic material.

10. The combination of claim 6, wherein the outer sheath comprises an organic material.

11. The combination off claim 6, wherein the line includes a maximum length of elongation, and wherein said maximum length of elongation is provided by a maximum distance to which the sheath is extendable.

12. A waist positioned firearm rest in combination with a firearm, wherein the combination comprises:

a) the firearm, wherein the firearm includes a butt stock and is massive, wherein the firearm is selected from the group of firearms consisting of rifles, shotguns, muzzle loaders, assault firearms, light machine guns and portable rocket launchers; and b) the waist positioned firearm rest, wherein the waist positioned firearm rest comprises:

i) a base adapted to be worn by the user at his or her waist to support a weight of the firearm wherein the base comprises a folded over strip of material that forms a belt loop;

ii) a line depending from the base, wherein the line forms a loop, wherein the line is of sufficient strength to support the weight of the firearm, wherein the line comprises at least one elastic portion such that, when the butt stock of the firearm is placed in the loop on a portion of the line, a weight of the firearm is supported by the line and the elastic portion stretches to absorb shocks caused by upward and downward movements of the firearm relative to the user wearing the base; and iii) wherein the base is a support for the line which in turn supports the weight of the firearm that is massive such that the firearm rest supports the firearm when the user is walking and such that the firearm rest absorbs walking generated force.

13. The combination of claim 12, wherein the base includes a width that is relatively long to distribute pressure over a relatively great area of the belt.

14. A waist positioned firearm rest in combination with a firearm and adapted for attachment to a belt worn about a waist of a user, wherein the firearm includes a butt stock, wherein the firearm rest comprises:

a) a base adapted to be worn by the user at his or her waist, wherein the base comprises a strip of foldable material forming a belt loop, wherein the belt loop engages the belt wherein the strip of foldable material comprises leather; and b) a line depending from the base, wherein the line forms a line loop, wherein the line is of sufficient strength to support a weight of the firearm, wherein the line comprises at least one elastic portion such that the loop may expand and retract in size and such that, when the butt stock of the firearm is placed in the line loop on a portion of the line, a weight of the firearm is supported by the line and the elastic portion stretches to absorb shocks caused by upward and downward movements of the firearm relative to the user wearing the base while walking.

* * * * *